United States Patent [19]

Howanitz et al.

[11] 3,993,575

[45] Nov. 23, 1976

[54] HARD SURFACE ACID CLEANER AND BRIGHTENER

[75] Inventors: Joseph Howanitz, Wayne, N.J.; Irwin Greenberg, Brooklyn, N.Y.

[73] Assignee: Fine Organics Inc., Lodi, N.J.

[22] Filed: May 27, 1975

[21] Appl. No.: 580,720

[52] U.S. Cl. ..... 252/142; 252/544; 252/546; 252/548

[51] Int. Cl.[2] ..... C11D 7/32

[58] Field of Search ..... 252/142, 145, 148, 529, 252/525, 527, 548, 544, 546; 134/3, 41

[56] References Cited

UNITED STATES PATENTS

| | | | |
|---|---|---|---|
| 2,901,434 | 8/1959 | Butcosk | 134/41 X |
| 3,072,502 | 1/1963 | Alfano | 134/3 |
| 3,166,444 | 1/1965 | Ehren et al. | 252/142 X |

*Primary Examiner*—Harris A. Pitlick

[57] ABSTRACT

An acid cleaner and brightener concentrate composition comprising a dicarboxylic acid, an amine and water having a pH of about 1 to about 3 is useful in removal of tenacious soil, such as tarnish, discoloration, corrosion and oxidation products from vehicles, such as railroad rolling stock, without subsequent harm to surfaces, including coated polycarbonate glass substitute.

13 Claims, No Drawings

HARD SURFACE ACID CLEANER AND BRIGHTENER

The present invention relates to a cleaning composition, and more particularly to a cleaning composition useful in cleaning railroad rolling stock without harm to coated polycarbonate glass substitute.

The cleaning of railroad equipment, and particularly rolling stock, has been traditionally effected with strong acid cleaners, due to the fact that the soil accumulated on railroad rolling stock is particularly difficult to remove. Analysis of soil encountered on railroad car bodies reveals a mixture of gritty road ballast dust, iron particles from brake shoes and wheels and combustion products from locomotives. Equipment operated over routes including tunnels accumulate particularly heavy coatings of highly tenacious soil. Combustion products from diesel locomotives condense to form a heavy adherent film that binds the iron particles and ballast dust firmly to car surfaces. Exposure to moisture causes the iron to rust and, in almost no time, the calssic brown surfaces appear. Nevertheless, this difficultly removable soil has been removed by use of strong acid, e.g. mineral acid, cleaners. See, e.g. U.S. Pat. No. 3,793,221, which proposes a thickened acid cleaner composition for cleaning railroad vehicles comprising an aqueous hydrochloric acid, one or more of oxalic, tartaric and citric acids, a nonionic surfactant, an anionic surfactant and water.

Recently, however, coated polycarbonate glass substitute has been used to replace conventional glass in railroad rolling stock, and it has been found that the strong mineral acid cleaners attack the coated polycarbonate, resulting in pitting and otherwise marring of the coated polycarbonate. There is thus a need for a cleaner for railroad rolling stock that will be sufficiently strong to remove the tenacious soil without harming the coated polycarbonate glass substitute used in such rolling stock.

It is an object of the present invention to provide a cleaning composition capable of removing a variety of tenacious soil, particularly from railroad rolling stock, without adverse effects on coated polycarbonate glass substitute.

It is a further object of the invention to provide an acid cleaning composition that avoids the use of mineral acids.

These and other objects of the invention are fulfilled by the cleaning composition of the present invention, which comprises an aqueous solution of from about 5 to about 30 per cent, based on the total composition, of a dicarboxylic acid of 2 to 6 carbon atoms and an amount of an amine of the formula:

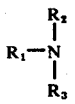

(I)

where $R_1$ and $R_2$ are independently selected from hydrogen, lower alkyl, or hydroxy lower alkyl, and $R_3$ is lower alkyl, lower cycloalkyl or hydroxy lower alkyl sufficient to provide the solution with a pH of from about 1 to about 3, preferably about 1 to about 2.5.

Throughout the present application, the term lower alkyl denotes a univalent, saturated, branched or straight chain hydrocarbon radical of from 1 to 6 carbon atoms. The term lower cycloalkyl denotes a univalent, saturated, cyclic hydrocarbon radical of 3 to 6 carbon atoms.

In a preferred embodiment of the invention, the cleaning composition may also include a hydroxy carboxylic acid containing 1–6 hydroxy groups and 1–3 carboxylic acid groups and an acid stable wetting agent.

The dicarboxylic acid and, when present, the hydroxy carboxylic acid, possess the ability to chelate iron, but they must be soluble in the cleaning composition for them to perform. A problem in the past has been the solubility of the dicarboxylic acid, e.g. oxalic acid, in aqueous media. Normally up to 10 per cent, by weight, of dicarboxylic acid has been the maximum amount found in any liquid cleaning composition concentrate based on solubility characteristics. For example, U.S. Pat. No. 3,166,444 proposes a composition for cleaning metal articles, especially ferrous metals, comprising from 0.05 to 3% each of tartaric acid, oxalic acid and citric acid, together with a surfactant, and an ammonium, substituted ammonium or metal cation so that the pH lies within the range from about 3.0 to about 6.5. However, by partially neutralizing the organic acid with the amine (I) according to the present invention, it is now possible to incorporate up to about 30 per cent of the organic acid and still provide proper cleaning characteristics. This is essential, since unless the pH and acid concentration set forth above are adhered to, the composition of the invention is not able to clean as required.

By eliminating the mineral acids from the cleaner of the present invention, it is now possible to attain a higher level of cleaning with a lower total acid content. This makes the cleaning composition of the present invention much safer for individuals to handle. In the past, acid contents have normally run between about 20 per cent and 60 per cent, whereas the cleaning composition of the invention has a calculated acid content (as HCl) of only about 4 per cent to about 12 per cent. Another advantage is having a relatively low acid content is that waste disposal problems are alleviated, since large amounts of the cleaning composition of the present invention entering a waste disposal system will not substantially change the pH of the system.

Suitable dicarboxylic acids have the formula HOOC-R-COOH, where R is a direct bond or straight or branched chain alkylene of 1 to 4 carbon atoms, such as oxalic, malonic, succinic, glutaric and adipic acid, preferably oxalic acid. The acid may be anhydrous or hydrated, and the amount of the acid will be calculated on an anhydrous basis.

Suitable amines of formula (I) include ethylamine, ethanolamine, dimethylamine, cyclohexylamine, diethylethanolamine, methyldiethanolamine, and the like. Preferably, the amine (I) is a lower alkanolamine, wherein one, two or all three of $R_1$, $R_2$ and $R_3$ are hydroxy lower alkyl, most preferably a mono(hydroxy lower alkyl) amine, such as ethanolamine, butanolamine and the like. The mono-, di- and tri-lower alkanolamines are preferred because they readily solubilize the organic acid, giving rise to clear solutions. Where other amines are used, it may be necessary to use surfactants and other solubilizing aids.

The amine (I) is used in an amount to partially neutralize the dicarboxylic acid and any hydroxycarboxylic acid so as to provide a pH of from about 1 to about 3.

If the pH exceeds about 3, the cleaning ability of the composition falls off sharply. If the pH is below about 1.0, deleterious action occurs on the coated polycarbonate. Generally, a pH of from about 1 to about 3 will be obtained with an amount of amine (I) of from about 3 to about 15 per cent, based on the total composition, but more or less will be used depending on the amount required to give the desired pH. When inorganic bases, e.g. sodium hydroxide or potassium hydroxide, or ammonium hydroxide, are used in place of amine (I), the desired pH can be achieved but the dicarboxylic acid precipitates out of solution, either immediately or on storage. Accordingly, inorganic bases or ammonium hydroxide are not suitable.

When employed, the hydroxycarboxylic acid is used in an amount of from about 2 to about 6.5 per cent, based on the total composition, to aid in chelating iron and to improve rinsibility. Suitable hydroxycarboxylic acids include glycollic acid, lactic acid, malic acid, tartaric acid, citric acid, gluconic acid, and the like.

If desired, a small amount, such as from about 1 to about 4 per cent, based on the total composition, of an acid stable wetting agent may be employed to aid in detergency and rinsibility. Suitable wetting agents include alkali metal aliphatic or alkaryl sulfonates, alkali metal aliphatic sulfates, alkylcarboxypolyalkoxy alkanols, polyalkoxy alkanols, alkaryloxypolyalkoxy alkanols, polyoxyalkylene adducts of mono- and polyalkylphenols, fatty acids, fatty amides or fatty alcohols, and the like. Non-ionic surfactants are preferred, since they present fewer waste disposal problems. The polyoxyethylated alkanols are quite suitable in this regard.

Finally, the concentrated cleaning composition of the invention contains from about 44.5 to 90% water, based on the total composition. In addition to the foregoing ingredients, as is well known in the detergent art, the cleaning composition may also contain adjuvants, such as thickeners, dyes, perfumes, and the like.

The compositions of this invention are prepared by standard well known open kettle mixing techniques known in the industry. A convenient charge schedule for preparation of the composition at room temperature would be to charge the water to the vessel, charge the dicarboxylic acid and stir to obtain partial solubilization, followed by charging the amine to totally solubilize the dicarboxylic acid, followed by the hydroxycarboxylic acid and finally the surfactant. Should it be desired to add optional modifiers to the composition such as dyes, perfumes, and thickeners, they can be added as conveniently during the preparation of the composition.

The cleaning composition concentrate according to the invention is stable during storage and use. The composition has excellent freeze-thaw stability, which is particularly difficult to achieve with known acid compositions. The composition is stored as the concentrate and may be used for cleaning as such. Usually, the concentrate is diluted with water in the volume ratio of concentrate to water of up to about 1:20, preferably from about 1:1 to about 1:9.

Accordingly, the cleaning composition may comprise from about 0.25 to about 30% of the dicarboxylic acid, from about 0.15 to about 15% of the amine (I), from about 0.10 to about 6.5% of a hydroxycarboxylic acid (when present), from about 0.05 to about 4% of a wetting agent (when present) and from about 44.5 to about 99.6% water. In more preferred embodiments of the invention, there will be from about 0.5 to about 15%, most preferably from about 1 to about 10%, of the dicarboxylic acid, from about 0.3 to about 7.5%, most preferably from about 0.6 to about 5% of the amine (I), from about 0.2 to about 3%, most preferably from about 0.4 to about 2%, of the hydroxycarboxylic acid (when present), from about 0.1 to about 2%, most preferably from about 0.2 to about 1.5%, of the wetting agent (when present) and from about 72.5 to about 99%, most preferably from about 81.5% to about 97%, water.

The composition of the invention, either as the concentrate or diluted, is used to clean any surface, such as steel, stainless steel, aluminum, glass, polycarbonate glazing, painted surfaces, etc. In use, the cleaning composition is flowed or sprayed onto the surface to be cleaned at any desired temperature to obtain physical coverage of the surface so that a thin but continuous film is obtained. It is an advantage of the present invention that the composition can be used at ambient temperatures. No brushing, scrubbing or other similar effort is required when the concentrate is used as such or is diluted up to about 1:3, by volume. At higher dilutions, such as from about 1:4 to about 1:20, by volume, light brushing is recommended prior to final rinse.

The cleaning composition is allowed to remain in contact with the surface at least 3 minutes, and preferably 7 minutes. Longer dwell time is satisfactory when the vehicle is cleaned during cold weather. It is an advantage of the composition of the present invention that even if the water evaporates during the period of application, the composition can still be successfully rinsed afterwards. Rinsing is achieved by the use of water being sprayed on the vehicle with impingement force and is most conveniently achieved by simply passing the vehicle through the water spray rinse. The type of surface being washed will dictate the type of equipment to be used. The cleaning composition of this invention is suitable for cleaning trucks and trailers, buses, airplanes, railroad engines, boxcars, passenger cars, cabooses, off-road equipment, building surfaces, tunnel and bridge structures and other general equipment and structures.

The practice of this invention is illustrated by the following Examples. Unless otherwise stated, all parts and proportions referred to herein and in the appended claims are by weight.

EXAMPLE I

To an open kettle mixing vessel 77.2 parts of water was charged and then 10 parts of oxalic acid dihydrate was partially dissolved therein. Then 3.3 parts of monoethanolamine was added to totally dissolve the oxalic acid. With continued agitation 5 parts of 50% gluconic acid in water was blended in along with 4 parts of a nonionic surfactant of the modified oxyethylated straight chain alcohol type (Plurafac D-25). Finally, 0.5 part of an acid stable thickening agent, Xanthan gum polysaccharide (Kelzan), was added. The completed thickened composition was then discharged from the vessel. The pH of the composition was 1.5.

The foregoing concentrate was diluted with 3 volumes of water and stirred to obtain a uniform mixture. The composition was then applied by spraying to a dirty passenger railroad car so that the passenger railroad car had a very thin continuous coating of the composition. Approximately 3 gallons of the composition were applied to the passenger car over a period of about 5 minutes. The passenger railroad car was then rinsed by spraying water with a common garden hose to remove the acid cleaner. Upon drying, the passenger railroad car was examined for cleanliness. The surface was uniformly clean, including the polycarbonate glass substitute windows. There was no evidence of residual siliceous road soil or oily contamination and no streaking or spotting. The painted surfaces appeared to return to their original luster.

EXAMPLE II

To compare the composition of Example I with a commonly used mineral acid cleaner, a control composition was prepared as follows:

| Control | Wt. % |
|---|---|
| Sulfuric acid, 98% | 20.0 |
| Oxalic acid | 5.0 |
| Nonionic surfactant of Example I | 2.0 |
| Propylene glycol | 5.0 |
| Thickener of Example I | 0.75 |
| Water | Q.S. |
| Total | 100.0 |

pH of Control = 0.4

Compositions A-G were then prepared over a range of pH from 1.0 to 3.5 as follows:

| | Parts By Weight |
|---|---|
| Water | 77.00 |
| Oxalic acid dihydrate | 10.00 |
| Gluconic acid in water, 50% | 5.00 |
| Nonionic surfactant of Example I | 4.00 |
| Monoethanolamine | Q.S. to desired pH |

Controlled cleaning tests were performed on steel panels obtained from an oxidized and soiled exterior railroad passenger car using a composition according to the invention and a commonly used mineral acid cleaner as a control. The composition of the invention was used at several pH values by varying the amount of monoethanolamine to give the desired pH. The soiled steel panels were sprayed at room temperature with the control solution and with concentrates A-G, diluted with water at a 1:3 dilution ratio, by volume, allowed a 5-minute dwell time on the panels, rinsed with cold water, allowed to dry and evaluated for cleaning. Each test was carried in duplicate. The results are reported in Table I below as an average of the two tests for each sample.

Table I

| Composition | pH | Soil Removal (%) |
|---|---|---|
| Control | 0.4 | 100 |
| A | 1.0 | 100 |
| B | 1.6 | 100 |
| C | 2.0 | 100 |
| D | 2.5 | 95* |
| E | 3.0 | 62.5** |
| F | 3.2 | 50 |
| G | 3.5 | 30 |

*average of 90% and 100%
**average of 60% and 65%

According to the standards for this test, a percentage soil removal of 50% or less is a failure, while a percentage soil removal of more than 50% indicates that the test sample passes the test and is acceptable.

EXAMPLE III

Following the procedure of Example II, compositions H–P were prepared in the same manner as compositions A–G. Panels made of polycarbonate glass substitute were spotted with compositions H–P and with the control composition of Example II at room temperature, maintained at 100° F until dry, rinsed and examined for attack by the composition on the panel. The tests used the concentrate as such, without dilution, since this is the standard used by consumers of this type of cleaner. The use of the concentrate accelerates any deleterious action of the cleaner and simulates prolonged and repeated usage. The results are in Table II below:

Table II

| Composition | pH | Observations |
|---|---|---|
| Control | 0.4 | Heavy attack, polycarbonate glass substitute is rendered opaque - unsuitable for use. |
| H | 0.8 | " |
| I | 1.0 | No attack - remains clear. |
| J | 1.2 | " |
| K | 1.6 | " |
| L | 2.0 | " |
| M | 2.5 | " |
| N | 3.0 | " |
| O | 3.2 | " |
| P | 3.5 | " |

EXAMPLE IV

Standard immersion 24-hour corrosion studies were run at room temperature on 1020 cold rolled steel, 303 stainless steel and alclad aluminum QQA362 using the control of Example II and concentrate Q, which is prepared according to the procedure of Example II for preparing concentrates A–G. Concentrate Q has a pH of 1.5. The control and concentrate Q were run at full strength, and at a dilution of 1:9, by volume. The results are reported in Tables III and IV as the change in weight/square inch/day, with the negative numbers being a loss and the positive numbers a gain in weight.

Table III

| | Concentrate | |
|---|---|---|
| | Composition Q: Weight change | Control: Weight change |
| Aluminum | −0.99 mg/in²/24 hrs. | −3.1 mg/in²/24 hrs. |
| Stainless steel | −0.02 mg/in²/24 hrs. | −10.57 mg/in²/24 hrs. |
| 1020 steel | +1.32 mg/in²/24 hrs. | −13.38 mg/in²/24 hrs. |

Table IV

| | Dilution 1:9 | |
|---|---|---|
| | Composition Q: Weight change | Control: Weight change |
| Aluminum | −0.5 mg/in²/24 hrs. | −1.94 mg/in²/24 hrs. |
| Stainless steel | −0.02 mg/in²/24 hrs. | −0.07 mg/in²/24 hrs. |
| 1020 steel | +0.97 mg/in²/24 hrs. | −7.38 mg/in²/24 hrs. |

EXAMPLE V

Following the procedure of Example I, the following materials were mixed in the kettle mixing vessel to give a concentrate of pH 1.44:

Composition R

| | Percentage |
|---|---|
| Water | 82.45 |
| Oxalic acid | 10.0 |
| Monoethanolamine | 3.3 |
| Nonionic surfactant of Example I | 4.0 |
| Thickener of Example I | 0.25 |

Composition R and the concentrate of Example I were used to clean soiled steel railroad passenger car panels using the procedure described in Example II, both at full strength and at 1:3 and 1:15 dilutions, by volume. The results are reported in Table V below:

Table V

| | | Soil Removal |
|---|---|---|
| Composition R | Full strength | 100% |
| | 1:3 dilution | 100% |
| | 1:15 dilution | 75% |
| Composition of Example I | Full strength | 100% |
| | 1:3 dilution | 100% |
| | 1:15 dilution | 75% |

EXAMPLE VI

Following the procedure of Example II, compositions S, T and U were prepared at pH 3.0, 2.5 and 1.5, respectively. Further, the composition of Example 4 of U.S. Pat. No. 3,166,444 was prepared as follows:

| | Parts by weight |
|---|---|
| Tartaric acid | 40 |
| Oxalic acid | 80 |
| Sodium citrate | 20 |
| Sodium dodecylbenzene sulfonate | 10 |
| Trimethyl amine | Q.S. to give pH = 3.0 |

and was designated Prior Art.

The four compositions were used without dilution to clean the soiled stainless steel railroad passenger car panels using the procedure described in Example II. The results are reported in Table VI below:

Table VI

| | pH | Soil Removal (%) |
|---|---|---|
| Prior Art | 3.0 | 20* |
| Comp. S | 3.0 | 75 |
| Comp. T | 2.5 | 100 |
| Comp. U | 1.5 | 100 |

*average of 10% and 30%.

These results show that even at the same pH, the compositions of the invention are substantially more effective than the composition of the prior art.

As a matter of interest, when Compositions T and U, preferred compositions of the invention, were diluted 1:3 by volume and used to clean the soiled steel panels according to the test procedure of Example II, Composition T (diluted 1:3) resulted in removal of 80% of the soil and Composition U (diluted 1:3) resulted in 100% of the soil.

What is claimed is:

1. A cleaner concentrate, comprising an aqueous solution of from about 5 to about 30 per cent of a dicarboxylic acid of the formula HOOC—R—COOH, where R is a direct bond or straight or branched chain alkylene of 1 to 4 carbon atoms and from about 3 to about 15% of an amine of the formula:

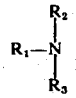

where $R_1$ and $R_2$ are independently selected from hydrogen, lower alkyl, or hydroxy lower alkyl, and $R_3$ is lower alkyl, lower cycloalkyl or hydroxy lower alkyl, the amount of the amine being sufficient to provide the solution with a pH of from about 1 to about 2.5.

2. The concentrate according to claim 1, wherein at least one of $R_1$, $R_2$ and $R_3$ is hydroxy lower alkyl.

3. The concentrate according to claim 2, wherein the amine is monoethanolamine.

4. The concentrate according to claim 1, wherein the dicarboxylic acid is selected from the group consisting of oxalic, malonic, succinic, glutaric and adipic acid.

5. The concentrate according to claim 4, wherein the dicarboxylic acid is oxalic acid.

6. The concentrate according to claim 1, including from about 2 to about 6.5 per cent of a hydroxycarboxylic acid, based on the total composition.

7. The concentrate according to claim 6, wherein the hydroxycarboxylic acid is selected from the group consisting of glycollic, lactic, malic, tartaric, citric and gluconic acid.

8. The concentrate according to claim 6, wherein the hydroxycarboxylic acid is gluconic acid.

9. The concentrate according to claim 1, including from about 1 to about 4 per cent of an acid stable wetting agent.

10. The concentrate according to claim 9, wherein the acid stable wetting agent is a nonionic surfactant.

11. A cleaner concentrate consisting essentially of from about 5 to about 30 per cent of a dicarboxylic acid of the formula HOOC—R—COOH, where R is a direct bond or straight or branched chain alkylene of 1 to 4 carbon atoms, from about 3 to about 15 per cent of an amine of the formula:

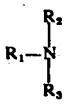

where $R_1$ and $R_2$ are independently selected from hydrogen, lower alkyl, or hydroxy lower alkyl, and $R_3$ is lower alkyl, lower cycloalkyl or hydroxy lower alkyl; at least one member selected from the group consisting of from about 2 to about 6.5 per cent of a hydroxycarboxylic acid having from 1 to 6 hydroxy groups and 1 to 3 carboxylic acid groups and from about 1 to about 4 per cent of an acid stable wetting agent; and from about 44.5 to about 90 per cent water; the concentrate being in the form of an aqueous solution; the amount of the amine being sufficient to provide the solution with a pH of from about 1 to about 2.5.

12. The concentrate according to claim 11, wherein at least one of $R_1$, $R_2$ and $R_3$ is hydroxy lower alkyl.

13. The concentrate according to claim 11, wherein the dicarboxylic acid is selected from the group consisting of oxalic, malonic, succinic, glutaric and adipic acid.

* * * * *